US009463508B2

(12) United States Patent
Berglund et al.

(10) Patent No.: US 9,463,508 B2
(45) Date of Patent: Oct. 11, 2016

(54) METHOD FOR MANUFACTURING A COMPONENT WITH INTERNAL CAVITIES

(75) Inventors: Tomas Berglund, Falun (SE); Rickard Sandberg, Sandviken (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 620 days.

(21) Appl. No.: 13/884,622

(22) PCT Filed: Nov. 9, 2011

(86) PCT No.: PCT/EP2011/069701

§ 371 (c)(1),
(2), (4) Date: May 10, 2013

(87) PCT Pub. No.: WO2012/062786

PCT Pub. Date: May 18, 2012

(65) Prior Publication Data

US 2013/0224058 A1 Aug. 29, 2013

(30) Foreign Application Priority Data

Nov. 10, 2010 (EP) ..... 10190593

(51) Int. Cl.
*B22F 3/15* (2006.01)
*B22F 7/04* (2006.01)
(Continued)

(52) U.S. Cl.
CPC . *B22F 7/04* (2013.01); *B22F 3/15* (2013.01); *B22F 5/10* (2013.01); *B22F 7/08* (2013.01); *B22F 5/008* (2013.01); *B22F 2999/00* (2013.01)

(58) Field of Classification Search
CPC ..... B22F 3/15; B22F 7/04
USPC ..... 419/8
See application file for complete search history.

(56) References Cited

U.S. PATENT DOCUMENTS 4,383,854 A 5/1983 Dembowski
2009/0226338 A1 9/2009 Troitski

FOREIGN PATENT DOCUMENTS

CH EP 1657010 A1 * 5/2006 ..... B22F 5/10
EP 1657010 A1 5/2006

(Continued)

OTHER PUBLICATIONS

Bergles, Arthur E. "The Imperative to Enhance Heat Transfer." Heat Transfer Enhancement of Heat Exchangers. Dordrecht: Kluwer Academic, 1999. 13-29.*

(Continued)

*Primary Examiner* — Jessee Roe
*Assistant Examiner* — Anthony Liang
(74) *Attorney, Agent, or Firm* — Corinne R. Gorski

(57) ABSTRACT

A method for manufacturing a component having at least one internal cavity includes the step of providing a core element of metallic material that includes at least one cavity having a first opening covered by a cover element with a first and second side. A form partially surrounds the core element and cover element. The form is filled with metallic filling material and heated in a heating chamber that is pressurized with gas for a predetermined time period at a predetermined temperature and a predetermined isostatic pressure, so that a metallurgical bond is achieved between the core element, cover element and metallic filling material. The core element is arranged such that, after filling the form with metallic filling material, the second side of the cover element is covered with metallic filling material so that the cavity during heating is pressurized to the predetermined isostatic pressure.

13 Claims, 5 Drawing Sheets

(51) Int. Cl.

| | |
|---|---|
| ***B22F 5/10*** | (2006.01) |
| ***B22F 7/08*** | (2006.01) |
| *B22F 5/00* | (2006.01) |

(56) References Cited

FOREIGN PATENT DOCUMENTS

| | | | |
|---|---|---|---|
| JP | S60166157 | A | 8/1985 |
| JP | H0589857 | A | 12/1993 |
| JP | H062613 | A | 1/1994 |
| JP | 2000511983 | T | 9/2000 |
| JP | 2005330873 | A | 12/2005 |
| WO | 9743525 | A | 11/1997 |

OTHER PUBLICATIONS

Laitinen et al. "Manufacturing technology development for vacuum vessel and plasma facing components", Fusion Engineering and Design, Elsevier Science Publishers, Amsterdam, NL. vol. 75-79, Nov. 1, 2005, pp. 475-480.

* cited by examiner

METHOD FOR MANUFACTURING A COMPONENT WITH INTERNAL CAVITIES

RELATED APPLICATION DATA

This application is a §371 National Stage Application of PCT International Application No. PCT/EP2011/069701 filed Nov. 9, 2011 claiming priority of European Application No. 0190593.3, filed Nov. 10, 2010.

TECHNICAL FIELD

The present invention relates to a method for manufacturing a component having at least one internal cavity according to the preamble of claim 1.

BACKGROUND ART

Hot isostatic pressing of metallic or ceramic powders, so called HIP or HIPPING is a commonly used manufacturing process for various components. In the HIP manufacturing process a capsule which defines the shape of the article is filled with a metal or ceramic powder of desired composition. The capsule is evacuated, sealed and thereafter subjected to increased temperature and pressure whereby the powder is densified into a compact body.

Some components comprise internal cavities, for example cooling channels. However, it is difficult to achieve components having curved internal channels with conventional methods such as milling or boring in metallic work pieces.

The documents WO2005/049251 and DE4426544 describe HIP methods for manufacture of components having internal channels. The internal channels are formed from pre-forms that are arranged within a mould that defines the shape of the article. The mould is filled with metallic powder and is heated under isostatic pressure whereby the metallic powder densifies to a compact article. The pre-forms are thereafter removed whereby an internal cavity remains in the article. It is also known to use preformed tubes to form the internal cavities in the component. The tubes remain in the compacted article after the heating and compacting step.

A problem with the above mentioned methods is that it is difficult to achieve high accuracy of the position of the internal cavities in the final component. This is mainly due to that the embedded channel forming pre-form moves when the powder is heated and subjected to high isostatic pressure during manufacture of the component.

Thus, it is an object of the present invention to provide an improved method for manufacture a component having at least one internal cavity which method solves at least one of the aforementioned problems.

SUMMARY OF THE INVENTION

According to the invention this object is achieved by the method for manufacturing a component having at least one internal cavity characterized by, providing at least a first preformed core element of metallic material that comprises at least one cavity having at least a first opening and a second opening, wherein said first opening is covered by a cover element having a first side and second side, wherein said first side is gastight joined to said at least first core element;

providing a form, at least partially defining the shape of the component, that at least partially surrounds said at least first core element and said cover element;

filling said form with metallic filling material;

heating, in a heating chamber that is pressurized with gas, during a predetermined time period at a predetermined temperature and a predetermined isostatic pressure so that a metallurgical bond is achieved between said at least first core element, said cover element and said metallic filling material, wherein said at least first core element is arranged such that, after filling said form with metallic filling material, said at least second side of said cover element is covered with metallic filling material and such that said cavity during heating is pressurized to the predetermined isostatic pressure through said at least second opening.

With the inventive method, a component may be manufactured that has internal cavities or channels of principally any shape or form. This is possible since a cavity of any shape, for example a circular groove, easily can be formed, e.g. milled, into the surface of the core element. By covering the groove with a cover element a continuous channel of closed cross-section is achieved in the core element. In the following steps of the method the core element is at least partially integrated into the body of the final component so that an internal cavity is provided in the component. The strength of the final component is very high since a metallurgical bond is formed between elements that make up the final component. The strength of the final component is substantially the same as in a component that has been manufactured from a forged, solid singular work piece. The rigidity and the lack of porosity of core element which comprise the internal cavity causes the core element to remain immovable during the heating step under isostatic pressure. Therefore is a very high dimensional accuracy of the position of the internal cavities achieved in the final component.

According to a preferred embodiment, the step of providing a first preformed solid core element comprises:

forming, in at least a first solid preformed core element of metallic material, at least one cavity which comprises at least two openings in the surface of said core element and at least a groove providing a further opening in the surface of said core element;

covering said further opening with at least a first cover element having a first side and second side, and gastight joining said first side of said cover element to said at least first core element, whereby said cavity forms a continuous channel of closed cross-section between said openings, Preferably, the cavity is formed by drilling and/or cutting and/or turning and/or spark erosion.

Said cavity may comprise a first and a second bore that extend in said core element from said first and second opening to said groove.

According to one alternative, said at least second opening is gastight connected to an inlet in the form.

According to one alternative, said form is a capsule that defines the shape of the component, wherein the at least first core element and cover element are arranged in said capsule.

According to one alternative, the form is gastight joined to the first core element so that the form and the first core element together define the shape of the component.

The metallic filling is preferably material metallic powder and/or metallic pieces.

According to one alternative, the method comprises the step of arranging at least an additional core element in contact with said first preformed core element.

According to one alternative, said additional core element may comprise at least a cavity wherein said additional core element is arranged such that the cavity and the cavity in the first core element communicate.

According to one alternative said cover element comprises several cover element sections that are gastight joined to each other and to said at least first core element.

Preferably, said cover element and/or said cover element sections is/are a plate or a machined part.

According to one alternative, said core element and/or the cover element comprises at least one cooling fin that extends within said cavity.

Preferably, the surface of said cavity is provided with a roughened surface for to increasing the cooling effect.

According to one alternative, the surface of said cavity is provided with pits or transversal grooves.

Preferably, the core element and the cover element are manufactured from any of the materials Ni-alloys, Co-alloys, Ti-alloys, Cu-alloys, Fe-alloys or tool steels or carbon steels or Hadfield type steels or stainless steels such as martensitic stainless steels, chromium steels or austenitic stainless steels or duplex stainless steels or mixtures thereof.

According to one alternative, the first core element and at least one additional core elements are manufactured from different materials.

DETAILED DESCRIPTION

Figure 1:
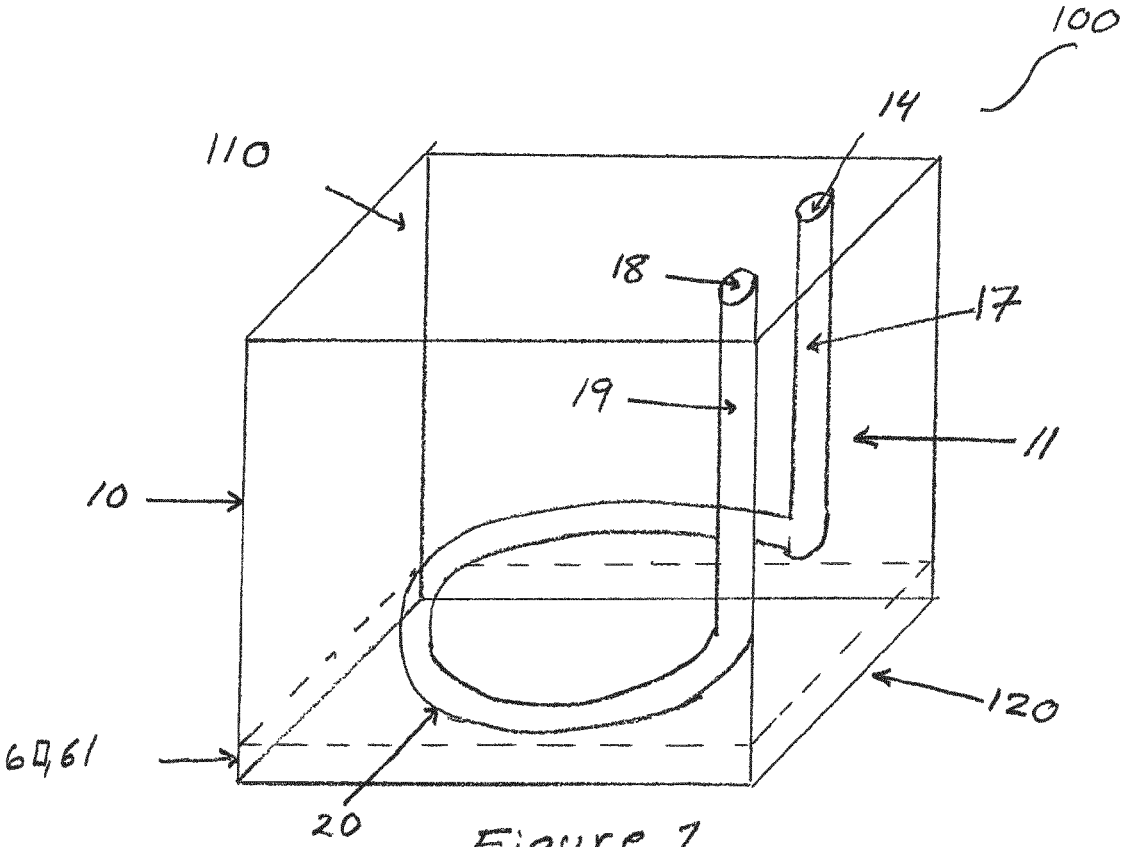
FIG. 1 shows schematically a component with an internal cavity that is manufactured according to a first preferred embodiment of the invention.

FIG. 1 shows a component 100 which is manufactured according to the method of the present invention. The component 100 comprises an internal cavity 11, i.e. a cavity which extends inside the body of the component. In principal, the component comprises a core element 10 which comprises the cavity 11 and a portion of metallic material 60, 61, which is metallurgically bonded to the core element. The cavity 11 may for example be a channel for cooling fluid for cooling the component. The channel 11 has a closed cross-section and extends between a first and a second opening 14 and 18, which are located on the upper surface 110 of the component. A first portion 17 of the channel extends perpendicular from the opening 14 towards a lower surface 120 of the component. At a predetermined distance from the lower surface 120, the channel 11 changes direction and extends in a circular form 20, parallel to the lower surface of the component. The circular portion 20 of the channel extends to a second perpendicular portion 19 of the channel which in turn extends to the opening 18 on the upper surface of the component. In operation, cooling fluid, such as water, is introduced through opening 14. The cooling fluid flows through the channel 11, removes heat from the lower portion of the component and exits through the second opening 18 on the upper surface of the component.

It should be pointed out that the above description is a general description of a component that may be manufactured with the inventive method. It is obvious that the method can be applied for manufacture of any type of components with an internal cavity. For example components for diesel engines such as an air cooled valve spindle or a fluid cooled valve seat. The component could also be a fluid cooled bearing, a fluid cooled roll or a fluid cooled heat shield. It is also obvious that the cavity 11, which extends inside the body of the component can be of any form or cross section and can extend in any manner within the component. It is further obvious that the cavity can comprise any number of openings and that the openings can be located on any outer surface of the component. It is also obvious that the component can comprise more than one channel.

In the following a first preferred embodiment of the inventive method for manufacturing a component having at least one internal channel will be described.

Figure 2A:
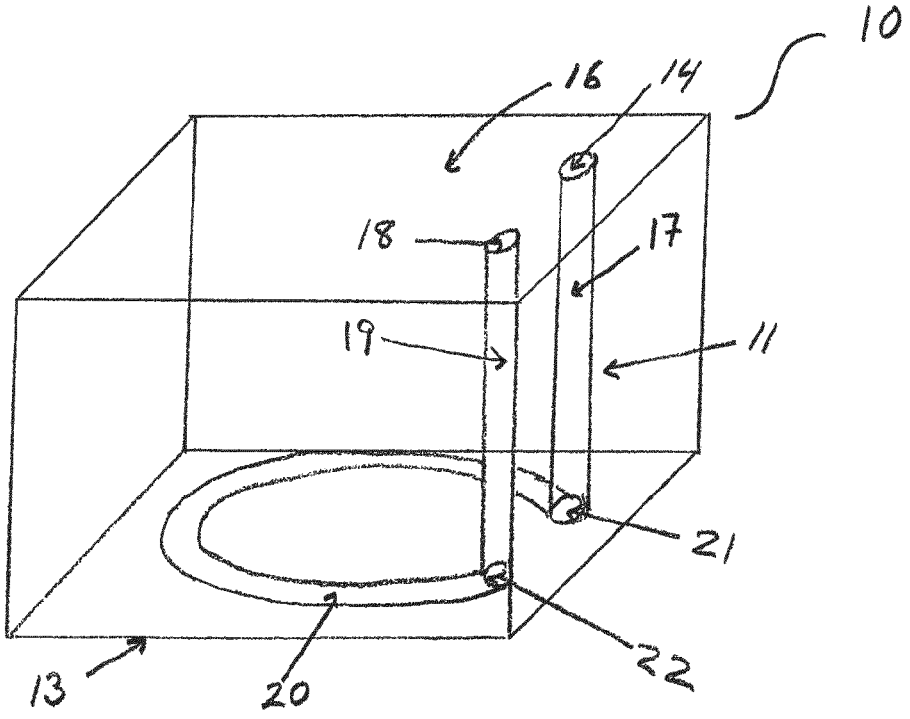
FIG. 2*a*-2*c* show respectively: a schematic perspective view of a core element that is used in the first preferred embodiment of the invention, a view of the lower side of the core element and a side view of the core element.

In a first step a core element is manufactured. FIG. 2*a* shows a core element 10 having a cavity 11. The core element 10 is manufactured from a solid block of metal material and can have any suitable form or size. The material of the core element can be any metallic material, for example any of the materials: Ni-alloys, Co-alloys, Ti-alloys, Cu-alloys or Fe-alloys, or tool steels or carbon steels or Hadfield type steels or stainless steels such as martensitic stainless steels, chromium steels or austenitic stainless steels or duplex stainless steels or mixtures thereof. The core element may be manufactured by any suitable method such as forging, rolling, casting, free-forming or sintering. However, for reasons that will be explained latter, the material of the core element must be gastight, i.e. it must be of closed porosity. Thereby is intended that the core element may contain pores but these pores may not be interconnected. Typically, the core element should have a porosity of less than 6%. In the present embodiment, the core element 10 is manufactured from forged carbon steel.

Figure 2B:
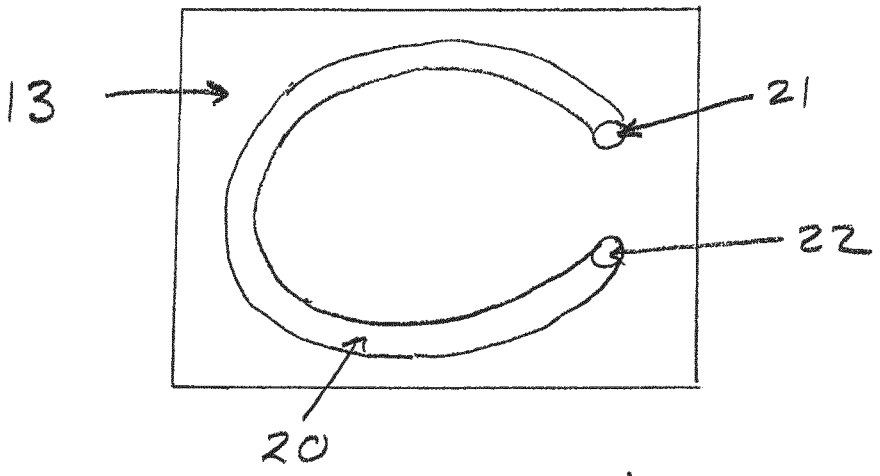
Figure 2C:
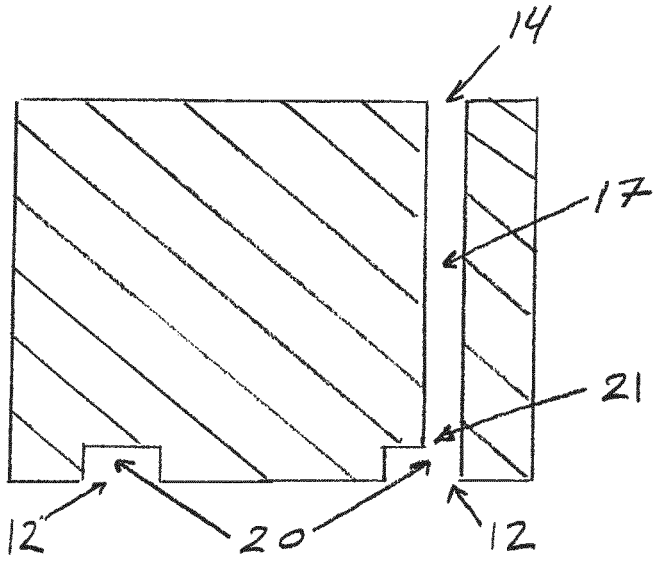

At least one cavity 11 is formed in the core element 10. The cavity may be formed by any suitable method such as drilling, milling, cutting, turning, spark erosion and power pressing followed by sintering. In the present embodiment, see FIG. 2*a*, the cavity 11 comprise two perpendicular bores 17, 19 that are drilled through the core element from its upper surface 16 to its lower surface 13. The bores 17, 19 thereby extend from two upper openings 14, 18 in the upper surface 16 of the core element to two lower openings 21, 22 on the lower surface 13 of the core element. The cavity 11 further comprises a circular shaped groove 20 that starts and ends at the lower openings 21, 22 of the bores 17 and 19, see FIG. 2*b*. The circular shaped groove 20 is milled into the lower surface 13 of the core element and therefore the groove is open on the lower surface 13. Thus, an opening 12 extends over the entire length of the groove 20. FIG. 2*c* shows a longitudinal cross section of the core element in which the opening 12 of the groove 20 is visible in the lower surface 13. Also visible is the perpendicular bore 17 through the core element and its upper and lower opening 14, 21.

In a second step, a cover element is provided. The cover element is arranged to cover openings in the core element that arise during the step of forming of the cavity in the core element, so that a continuous channel of closed cross section is achieved in the core element. It is obvious that if the core element comprises several cavities, several cover elements are provided.

The cover element may be manufactured from any metallic material and with any suitable method. For example, it can be cut out from strip or bar material, it can be a forged element, a machined body, a body of sintered metal powder or a free-formed body. However, the cover element needs to be gastight, e.g. of closed porosity. Preferably, the cover element is manufactured from any of the materials: Ni-alloys, Co-alloys Ti-alloys, Cu-alloys, Fe-alloys, or tool steels or carbon steels or Hadfield type steels or stainless steels such as martensitic stainless steels, chromium steels or austenitic stainless steels or duplex stainless steels or mixtures thereof. The cover element can be of any suitable shape, for example it may be flat plate or have a block shape. Its physical dimensions, e.g. its width and thickness, depend on the strength requirements of the final component and the process circumstances during manufacturing of the component. It is also possible to provide several cover element sections that together cover one or several openings in the core element. An advantage herewith is that openings of complicated shape in the core element easily can be covered. The use of cover element sections further reduces time consuming machining of the core element into complicated shape.

Figure 3B:
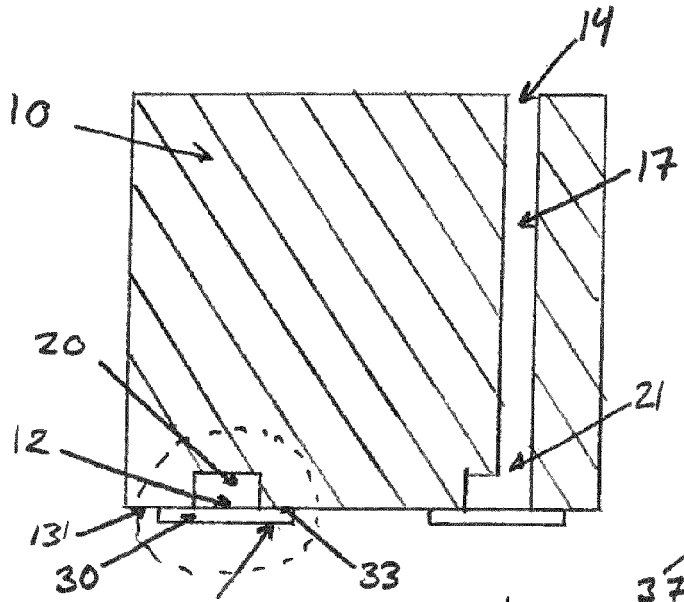
FIG. 3*a* shows schematically a top view of a cover element that is used in the first preferred embodiment of the invention, FIG. 3*b* show schematically a cross section of the core element and the cover element of the first preferred embodiment of the invention.
FIG. 3*c* is an enlarged view of a portion of FIG. 3*a*.
Figure 3A:
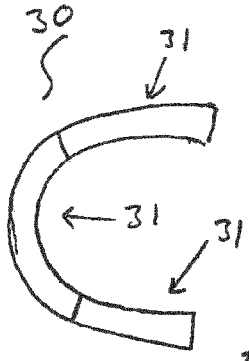

FIG. 3*a* shows a cover element 30 that has a partially circular shape and is manufactured from carbon steel strip. Thus, the cover element 30 is arranged to cover the opening 12 of the groove 20 in the core element 10 that is shown in FIG. 2*b*. FIG. 3*a* further indicates that the cover element 30 may comprise several cover element sections 31.

FIG. 3*b* is a cross-sectional view of a core element 10 to which a cover element 30 is gastight joined. FIG. 3*b* further shows the groove 20 and the opening 12 in the lower surface 13 of the core element as well as the bore 17 that extends between opening 14 in the upper surface of the core element and opening 21 in the lower surface of the core element. The cover element 30 has a first surface 33 and a second surface 34 and is positioned over the opening 12 in the lower surface 13 of the core element 10. The cover element 30 is positioned such that a portion of the first surface 33 of the cover element 30 is in direct metallic contact with a portion of the surface 13 of the core element 10, on each side of the opening 12. Thus, the cover element 30 is positioned such that it completely covers the groove 20 and the lower openings 21, 22 of the bores 17, 19 in the core element. Thus, a continuous channel 11 of closed cross-section is achieved in the core element. The continuous channel extends between the openings 14, 18 on the upper surface 16 of the core element. Since FIG. 3*b* is a cross-sectional view of the core element 13 only bore 17 and openings 14 and 21 are visible.

Figure 3C:
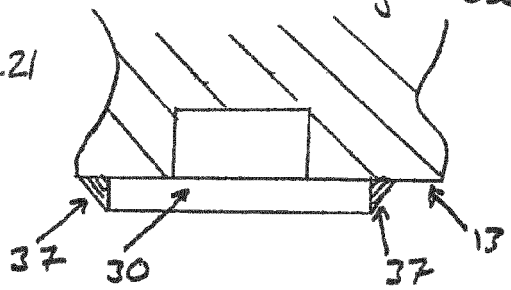

The cover element 30 is gastight joined to the core element. This may be achieved by welding the cover element to the surface 13 of the core element. FIG. 3*c* shows an enlarged portion of the encircled area in FIG. 3*b*. In FIG. 3 a gastight joint 37, e.g. a weld bead, is visible which is provided in the boundary between the surface 13 of core element 10 and the cover element 30. The gastight weld bead is provided around the whole periphery of the cover element.

In the case that the cover element 30 comprises several cover element sections, the cover element sections are gastight joined to each other and to the core element. This may be performed in any suitable order, e.g. first joining the sections to the core element and then to each other.

In a further step, a form is provided that at least partially defines the shape of the component and at least partially surround the assembly of the core element and the cover element.

Figure 4:
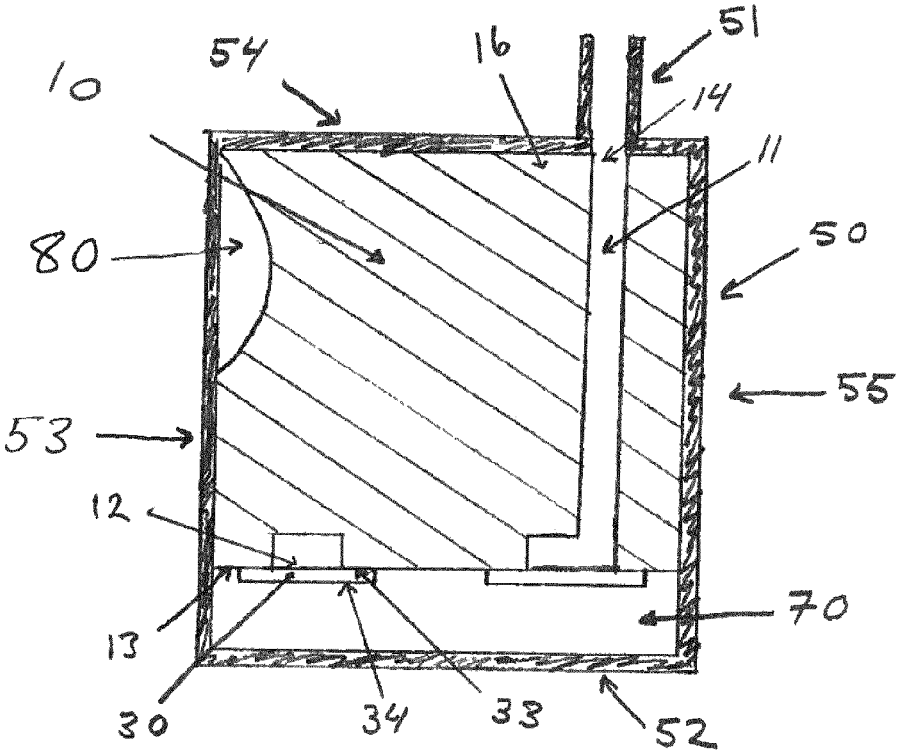
FIG. 4 shows schematically a cross section of an assembly of a core element and a cover element that are arranged in a capsule.

In the present embodiment, see FIG. 4, the form is a capsule 50 that defines the shape of the final component, i.e. the outer contour of the component. The capsule comprises a bottom wall 52 and four side walls, of which side walls 53 and 55 are visible. The capsule further comprises a cover 54 in which an opening 51 is provided for letting gas into the cavity 11 in the core element. The capsule is manufactured from metal sheets, such as mild steel sheets that are welded together.

At least one of the openings 14 and 18 on the upper side 16 of the core element 10 is connected to the gas inlet 51 in the capsule 50. The openings in the core element are thereby gastight joined to the opening in the form e.g. by a weld between the core element and the form. FIG. 4 only shows opening 14, which is connected to inlet 51. This allows gas to enter into the cavity 11 in the core element 10 during a subsequent heating step under isostatic pressure. The cavity 11 will therefore not be deformed during the heating step, since the cavity is pressurized to the same isostatic pressure that is acting on the capsule and on the core element.

According to the invention the core element 10 is designed and arranged in the capsule 50 such that a void 70, i.e. a space, is created between the capsule 50 and the surface 13 of the core element, see FIG. 4. The void 70 is created in a position where the cover element 30 is located.

The core element and/or the capsule may be also be arranged such that further voids are created between the walls of the capsule and the core element. FIG. 4 shows a void 80 between the core element and the side wall 53 of the capsule.

Figure 5:
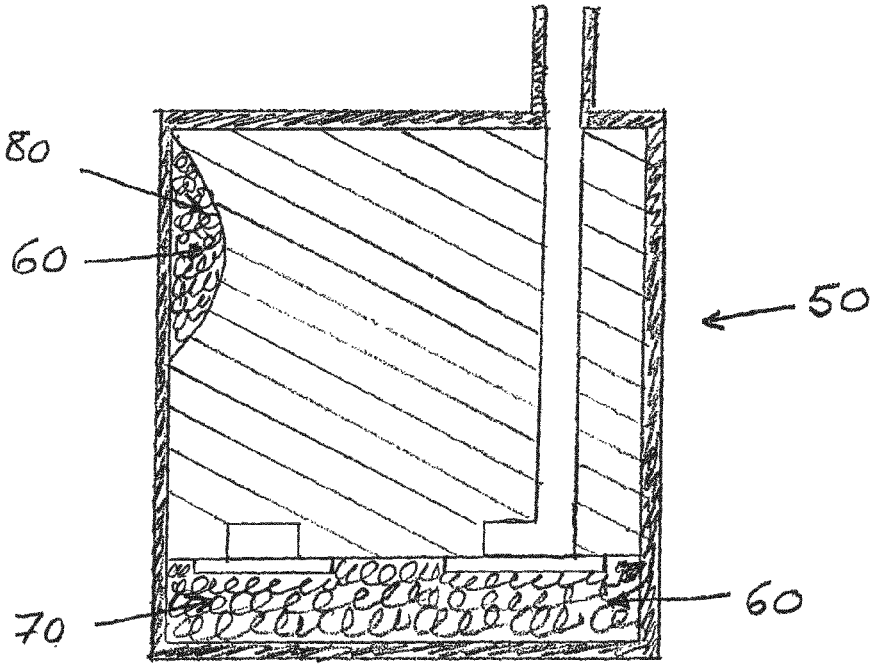
FIG. 5 shows schematically the assembly of FIG. 4 wherein the capsule which is filled with metallic filling material according to a first preferred embodiment of the invention.

The capsule is filled with metallic filling material. During filling of the capsule all voids in the capsule are filled with metallic material. FIG. 5 shows a capsule 50 that is filled with metallic material. In the present embodiment, the metallic material that is filled in the capsule 50 is a metallic powder 60 having a particle size of 1-500 μm. The metallic filling material could be any metallic material. Different voids could be filled with different types of metallic material. For example could void 80 be filled with a wear resistant alloy such as Co-based alloys, Ni-based alloys, high speed steel or MMC in order to provide wear resistance in an exposed area of the component.

By filling void 70, the surface 13 of the core element and the cover element 30 are covered with the metallic filling material. Therefore, in the final component, at least the cover element and preferably also the core element are covered by, and metallurgically bonded to, a layer of densified metallic material that constitutes an outer portion of the final component. Thus, the cover element and at least a part of the core element will be integrated in the final component.

Depending on the position of the core and cover element in the capsule the step of filling of the capsule may be performed before positioning the assembled core and cover element in the capsule or after the assembly has been positioned in the capsule. It is also possible that the capsule is first partially filled whereupon the core element is arranged in the capsule whereupon the capsule is completely filled.

In a further step the capsule, the core element, the cover element and the filling material are heated under a predetermined time period, at a predetermined temperature and predetermined pressure so that a metallurgical bond is achieved between the core element, the cover element and the filling material.

The capsule is thereby placed in a heatable pressure chamber, normally referred to as a HIP-chamber. The heating chamber is pressurized with gas, typically argon that is pumped into the chamber to an isostatic pressure in excess of 500 bar. The chamber is heated to a temperature below the melting point of the metallic materials in the capsule, e.g. 50-500° C. below the melting point of the material with the lowest melting point or any phase that can form by a reaction between the materials in the capsule. Typically, the capsule is heated for a period of 1-3 hours depending on the materials used and the size of the component.

As mentioned above, the cavity 11 in the core element 10 is pressurised during heating in order to prevent it from collapsing. It is important that no gas escapes from the cavity 11 into the metallic filling material, e.g. through the boundary between the cover element and the core element. If gas escapes from the cavity 11 into the metallic filling material, or into the boundary of other metallic elements in the capsule, a gas film will form between the particles or pieces of the metallic filling material and prevent these from forming a metallurgical bond. Therefore must the cover element be gastight joined to the core element.

For the same reason it is important that the material of the core element and the cover element does not comprise open porosity, i.e. that they do not comprise interconnecting pores through which the gas may escape.

Prior to the heating step a vacuum may be drawn in the capsule to ensure that all gas residues, e.g. air is removed from the capsule. All openings, except opening 51 that connects the cavity with atmosphere in the HIP-chamber, are thereafter sealed Due to the elevated pressure and temperature the core element, the cover element and the filling material deform plastically and bond metallurgically through various diffusion processes into a dense, coherent article. In metallurgic bonding, metallic surfaces bond together flawlessly with an interface that is free of defects such as oxides, inclusions or other contaminants. Two metallic elements that are bound together metallurgically will therefore form an integral body.

The capsule 50 is then allowed to cool and is, if necessary, subsequently stripped from the finished component.

Following are some further embodiments and alternatives of the present invention described.

Figure 6:
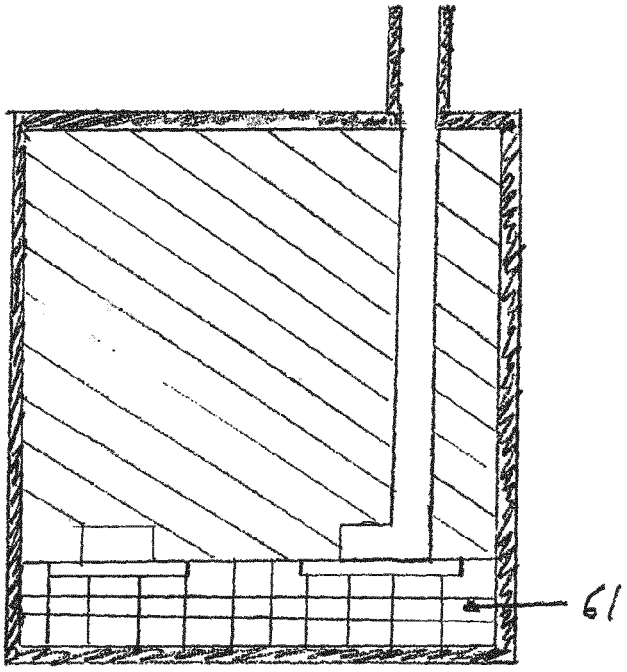
FIG. 6-9 show schematically further embodiments and alternatives of the present invention.

FIG. 6, shows an alternative in which the void between core and capsule is filled with metallic pieces 61. Other parts and details are the same as in the first described embodiment.

By "metallic pieces" is in this context intended pieces of metallic material that are substantially larger than the above mentioned powder particles. The pieces could have any shape and size suitable for filling the void between the capsule and the assembled core and cover element. The metallic pieces may be manufactured with the same methods and from the same materials as described under the core element.

Figure 7:
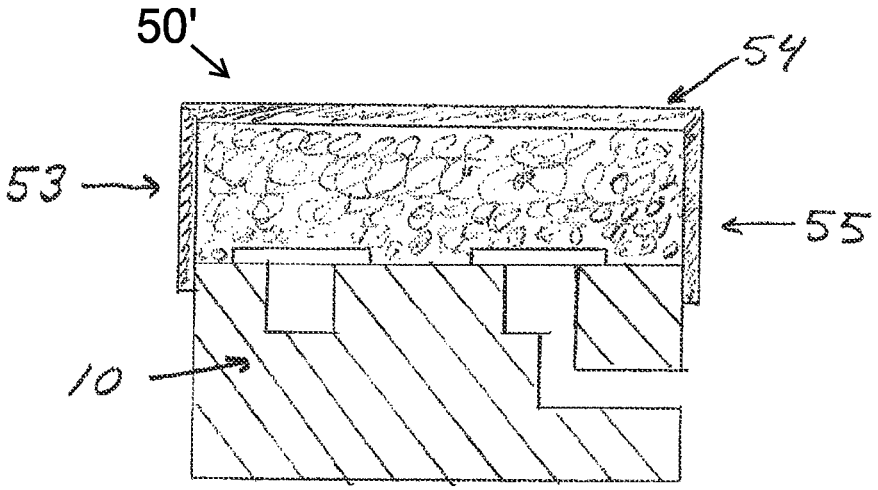

FIG. 7, shows and alternative in which a form 50' that partially defines the shape of the component is gastight joined to the core element 10. The form 50' has four side walls, of which side wall 53 and 55 are visible. The form 50' further comprises a cover 54. The side walls are gastight welded to the core element 10 so that form 50 partially surrounds the cover and core elements, which constitutes the bottom wall of the form. The shape of the final component is consequently defined by the form 50" and the core element 10 together. The advantage of this embodiment is that less sheet material needs to be formed and welded together. Thereby, the number of welds and joints, which could constitute potential leaks during HIP are reduced. In this case, the cavity 11 in the core element is directly open to the atmosphere in the heating chamber, as can be seen in FIG. 7. However, the form 50' could also include an outlet that is connected to cavity in the core element so that the cavity is pressurized during HIP. Other parts and details of this alternative are the same as in the first described embodiment.

Figure 8:
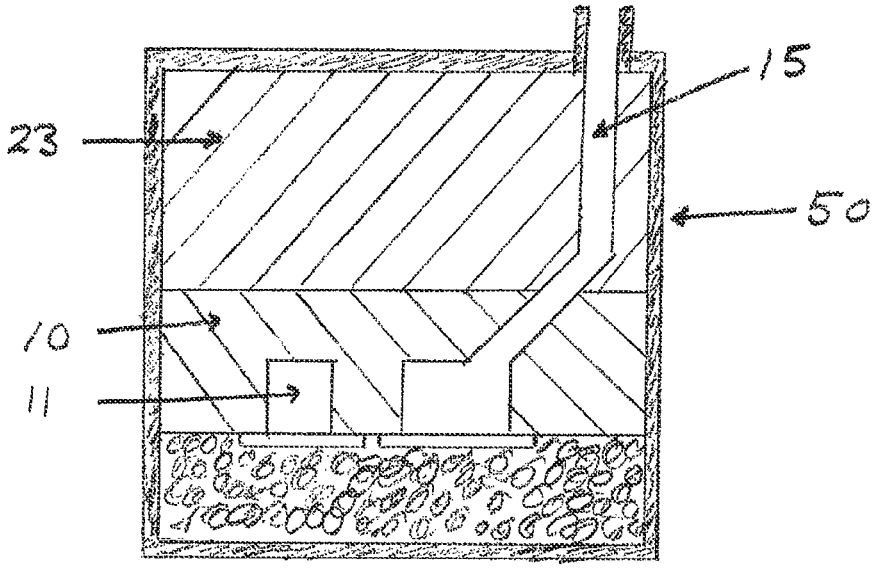

FIG. 8 shows an alternative in which, a first core element 10 and a second core element 23 are arranged in a capsule 50. The core elements 10 and 23 are arranged in metallic contact and welded gastight to each other. The core element 10 includes a cavity 11 and the core element 23 includes a cavity 15. The core elements 10, 23 are arranged such that the cavities 11 and 15 are in communication. Core elements 10 and 23 may be manufactured from different materials. In this case, core element 10 is manufactured from stainless steel and core element 23 is manufactured from carbon steel. The stainless steel core element 10 provides corrosion resistance in an exposed area of the component. The service life of the component is thereby lengthened. Furthermore is the component cost effective since a substantial portion thereof is manufactured from low cost carbon steel. Other parts and details of this alternative are the same as in the first described embodiment.

It is also possible to arrange further core elements adjacent elements 10 or 14, for example a core element of stainless steel or Ni-alloy which minimize the risk of diffusion of carbon from e.g. carbon steel metallic filling material (not shown in FIG. 8). It is also possible to arrange a third core element between the first core element and a second core element to prevent diffusion of alloy elements between the first and second core element (not shown in the figures).

Figure 9:
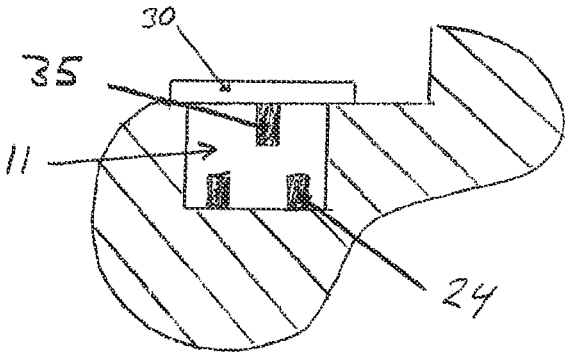

In order to improve the cooling efficiency in the component cooling fins could be formed in the cavity 11 and/or on the cover element 20, i.e. on a side which faces the cavity 11. FIG. 9 shows schematically two cooling fins 24 that are formed in the cavity 11 and a cooling fin 35 that is formed in the cover element 30. It is also possible to increase the turbulence of the cooling fluid flowing in the cavity 11 by roughening the surface of the cavity, e.g. by blasting with grit (not shown in FIG. 7). The increased turbulence increases the cooling effect. It is also possible to increase turbulence in the channel by transversal grooves or pits that are formed in the surface of the channel.

Although particular embodiments have been disclosed herein in detail, this has been done for purposes of illustration only, and is not intended to be limiting with respect to the appended claims. The disclosed embodiments and alternatives can also be combined. In particular, it is contemplated by the inventor that various substitutions, alterations, and modifications may be made to the invention without departing from the scope of the invention as defined by the claims. For example could the partial form described with reference to FIG. 7 be arranged around the two core elements described under FIG. 8. With regard to the metallic filling material it is for example possible to fill one or several voids with a mixture of metallic powder and metallic fitting material.

The invention claimed is:

1. A method for manufacturing a component having at least one internal cavity comprising the steps of:

forming, in at least a first solid preformed core element of metallic material, at least one cavity, the at least one cavity including two bores, each bore extending from one of two upper openings, located in an upper surface of the at least first core element, to one of two lower openings located in a lower surface of the at least first core element, and a groove extending between the two lower openings in the lower surface of the at least first core element;

covering the groove with at least a first cover element having a first side and second side, and gastight joining the first side of the cover element to the at least first core element, wherein the cavity forms a continuous channel of closed cross-section between the two upper openings in the upper surface of the at least first core element;

providing a form at least partially defining a shape of the component that at least partially surrounds said at least first core element and said at least first cover element;

filling said form with metallic filling material; and heating the form in a heating chamber that is pressurized with gas, during a predetermined time period at a predetermined temperature and a predetermined isostatic pressure, so that a metallurgical bond is achieved between said at least first core element, said cover element and said metallic filling material, wherein said at least first core element is arranged such that, after filling said form with metallic filling material, said at least second side of said cover element is covered with metallic filling material and such that gas is allowed to enter the channel through at least one of the two upper openings so that said cavity during heating is pressurized to the predetermined isostatic pressure.

2. The method according to claim 1, wherein the cavity is formed by drilling and/or cutting and/or turning and/or spark erosion.

3. The method according to claim 1, wherein one of the upper openings in said core element is gastight connected to an inlet in the form.

4. The method according to claim 1, wherein said form is a capsule that defines the shape of the component, wherein the at least first core element and the cover element are arranged in said capsule.

5. The method according to claim 1, wherein the form is gastight joined to the first core element so that the form and the first core element together defines the shape of the component.

6. The method according to claim 1, wherein the metallic filling material is metallic powder and/or metallic pieces.

7. The method according to claim 1, further comprising the step of arranging at least a second preformed core element in contact with said first preformed core element.

8. The method according to claim 7, wherein said at least second core element includes at least one cavity, wherein said second core element is arranged such that the cavity in the at least second core element and the cavity in the first core element communicate.

9. The method according to claim 7, wherein the first core element and the at least second core element are manufactured from different materials.

10. The method according to claim 1, wherein said cover element includes a plurality of cover element sections that are gastight joined to each other and to said at least first core element.

11. The method according to claim 1, wherein said core element and/or the cover element include at least one cooling fin that extends within said cavity.

12. The method according to claim 1, wherein the surface of said cavity is provided with a roughness for increasing a cooling effect.

13. The method according to claim 1, wherein the core element and the cover element are manufactured from any of the materials from the group of Ni-alloys, Co-alloys, Ti-alloys, Cu-alloys, Fe-alloys or tool steels or carbon steels or stainless steels such as martensitic stainless steels, chromium steels or austenitic stainless steels or duplex stainless steels or mixtures thereof.

* * * * *